US010403187B2

(12) United States Patent
Han et al.

(10) Patent No.: US 10,403,187 B2
(45) Date of Patent: Sep. 3, 2019

(54) GAMMA VOLTAGE DEBUGGING METHOD FOR ELECTROLUMINESCENT DISPLAY DEVICE AND APPARATUS THEREOF

(71) Applicant: BOE TECHNOLOGY GROUP CO., LTD., Beijing (CN)

(72) Inventors: Dongxu Han, Beijing (CN); Tieshi Wang, Beijing (CN); Pan Xu, Beijing (CN); Wenchao Bao, Beijing (CN); Chi Zhang, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 79 days.

(21) Appl. No.: 15/720,038

(22) Filed: Sep. 29, 2017

(65) Prior Publication Data

US 2018/0247577 A1 Aug. 30, 2018

(30) Foreign Application Priority Data

Feb. 24, 2017 (CN) ..... 2017 1 0102873

(51) Int. Cl.
*G09G 3/20* (2006.01)
*G09G 3/32* (2016.01)
(Continued)

(52) U.S. Cl.
CPC ..... *G09G 3/006* (2013.01); *G09G 3/30* (2013.01); *G09G 2320/0673* (2013.01); *G09G 2320/0693* (2013.01); *G09G 2360/145* (2013.01)

(58) Field of Classification Search
CPC ..... G09G 3/3233; G09G 5/10; H04N 9/67; G06T 3/20
See application file for complete search history.

(56) References Cited

U.S. PATENT DOCUMENTS 6,593,934 B1 7/2003 Liaw et al.
7,477,228 B2 * 1/2009 Wyatt ..... G09G 3/3406 345/102
(Continued)

FOREIGN PATENT DOCUMENTS

CN 101707050 A 5/2010
CN 102347001 A 2/2012
(Continued)

OTHER PUBLICATIONS

First Office Action for Chinese Patent Application No. 201710102873.7 dated May 29, 2019.

*Primary Examiner* — Lin Li
(74) *Attorney, Agent, or Firm* — Calfee, Halter & Griswold LLP

(57) ABSTRACT

A gamma voltage debugging method for an electroluminescent display device, including: turning on sub-pixels in a test region to a maximum luminance value, and recording a driving current of an electroluminescent element at this time as a maximum reference current; calculating reference current values corresponding to respective gray scales according to the maximum reference current and a preset formula; and driving the sub-pixels in the test region to emit light, and for each driving current equal to a reference current value, recording a driving voltage value corresponding to the gray scale value as a gamma voltage resulted from the debugging.

14 Claims, 2 Drawing Sheets

(51) Int. Cl.

| | |
|---|---|
| ***G09G 3/36*** | (2006.01) |
| ***H04N 9/67*** | (2006.01) |
| ***G09G 3/34*** | (2006.01) |
| ***G09G 3/00*** | (2006.01) |
| ***G09G 3/30*** | (2006.01) |

(56) References Cited

U.S. PATENT DOCUMENTS

RE40,738 E * 6/2009 Stewart ..... G09G 3/30 345/76
2002/0163490 A1 11/2002 Nose
2004/0233228 A1* 11/2004 Ota ..... G09G 3/3648 345/690
2004/0239654 A1* 12/2004 Okuda ..... G09G 3/3241 345/204
2006/0087521 A1* 4/2006 Chu ..... G09G 3/3648 345/690
2007/0120792 A1* 5/2007 Sasaki ..... G09G 3/3696 345/89
2010/0118062 A1* 5/2010 Mori ..... G09G 3/3225 345/690
2012/0019569 A1* 1/2012 Byun ..... G09G 3/3233 345/690
2014/0043310 A1* 2/2014 Pan ..... G09G 5/10 345/207
2015/0154762 A1* 6/2015 Yang ..... H04N 9/67 345/603
2016/0035293 A1* 2/2016 Furihata ..... G09G 3/36 345/694

FOREIGN PATENT DOCUMENTS

CN 104008736 A 8/2014
CN 105096827 A 11/2015
CN 105096896 * 11/2015 ..... G09G 3/36

* cited by examiner

GAMMA VOLTAGE DEBUGGING METHOD FOR ELECTROLUMINESCENT DISPLAY DEVICE AND APPARATUS THEREOF

CROSS-REFERENCE TO RELATED APPLICATIONS

The present application claims priority to Chinese Patent Application No. 201710102873.7, titled "Gamma voltage debugging method for electroluminescent display device and apparatus thereof", filed Feb. 24, 2017, the entire contents of which are incorporated herein by reference.

TECHNICAL FIELD

The present disclosure relates to the field of display technology, and more particularly, to a gamma voltage debugging method for an electroluminescent display device and an apparatus thereof.

BACKGROUND

A displaying gray scale of pixels of a display product may be adjusted by setting a gamma voltage. In a gamma voltage debugging method for an electroluminescent display device in the related art, a luminance meter has to be employed to monitor the luminance to identify the proper gamma voltage during the process of changing the voltage. Since the luminance and the voltage value should be measured and recorded at the same time, there may be an error due to decay of the luminance. Moreover, since many parameters need to be measured and the apparatus is complex, the gamma voltage debugging process is long and not suitable for mass production.

SUMMARY

The present disclosure provides a gamma voltage debugging method for an electroluminescent display device and an apparatus thereof.

In a first aspect, the present disclosure provides a gamma voltage debugging method, including the following steps turning on sub-pixels in a test region to a maximum luminance value, and recording a driving current of an electroluminescent element at this time as a maximum reference current;

calculating reference current values corresponding to respective gray scales according to the maximum reference current and a preset formula:

$$I_{GL} = I_{max}\left(\frac{GL}{N_{gray_max}}\right)^{y}$$

where $N_{gray_max}$ is a maximum gray scale value, GL is any gray scale between $[0, N_{gray_max}]$, and $\gamma$ is a default gamma value, $I_{max}$ is the maximum reference current value, and $I_{GL}$ is a reference current value corresponding to GL; and driving the sub-pixels in the test region to emit light, and for each driving current equal to a reference current value, recording a driving voltage value corresponding to the gray scale value as a gamma voltage resulted from the debugging.

In one implementation, the method also includes converting gamma voltage data resulted from the debugging into a hardware description language and generating a program burnt to a timing controller of the electroluminescent display panel.

Wherein driving the sub-pixels in the test region to emit light specifically includes: driving the pixel to emit light with a set of driving voltages having a linear relationship with the preset gray scales.

In addition, the method also includes: obtaining luminance values corresponding to respective gray scale values from the reference current values and luminous efficiency of the electroluminescent element. A luminance value corresponding to a gray scale value is a product of a reference current value corresponding to the gray scale value and the luminous efficiency of the electroluminescent element.

Wherein the maximum luminance value is a preset maximum displaying luminance of a sub-pixel of a certain color.

In another aspect, the present disclosure provides a gamma voltage debugging apparatus, applied to a display panel including an electroluminescent element, and the gamma voltage debugging apparatus including: a luminance detection unit configured to detect a luminance of a light emitted by a sub-pixel in a test region;

a current detection unit configured to record a driving current of the electroluminescent element as a maximum reference current when the luminance of the light emitted by the sub-pixel detected by the luminance detection unit reaches a maximum luminance value;

a current calculation unit configured to calculate reference current values corresponding to respective gray scale values according to the maximum reference current and a preset formula, the preset formula being:

$$I_{GL} = I_{max}\left(\frac{GL}{N_{gray_max}}\right)^{y}$$

where $N_{gray_max}$ is a maximum gray scale value, GL is any gray scale between $[0, N_{gray_max}]$, and $\gamma$ is a default gamma value, $I_{max}$ is the maximum reference current value, and $I_{GL}$ is a reference current value corresponding to GL; and a driving control unit configured to drive the sub-pixels in the test region to emit light, and when a driving current is equal to a respective reference current value, record the corresponding driving voltage value as a gamma voltage resulted from the debugging.

In one implementation, the gamma voltage debugging apparatus also includes a data conversion unit configured to convert the gamma voltage data resulted from the debugging into a hardware description language and generate a program burnt to a timing controller of the electroluminescent display panel.

Further, the apparatus also includes a luminance calculation unit configured to calculate the luminance values corresponding to respective gray scales according to reference current values corresponding to the respective gray scales acquired from the current calculation unit and the luminous efficiency of the electroluminescent element.

In one implementation, the luminance detection unit includes a dot type luminance meter.

BRIEF DESCRIPTION OF THE DRAWINGS

In order to more clearly illustrate the embodiments of the present disclosure or the related art, the following drawings, which are intended to be used in the description of the embodiments or the related art, are briefly described. It will be apparent that the drawings in the following description are merely exemplary embodiments of the present disclosure, and other drawings may be obtained based on these accompanying drawings by those skilled in the art without paying creative effort.

DETAILED DESCRIPTION

In order to make the object, technical solutions and advantages of the embodiments of the present disclosure more clearly, the technical solutions in the embodiments of the present disclosure will be described more thoroughly and fully below in connection with the drawings in the present disclosure. Apparently, the described embodiments are part of the present disclosure, not all of the embodiments. other embodiments obtained by those of ordinary skill in the art without making creative work are within the scope of this disclosure, based on the embodiments of the present disclosure.

The First Embodiment

Figure 1:
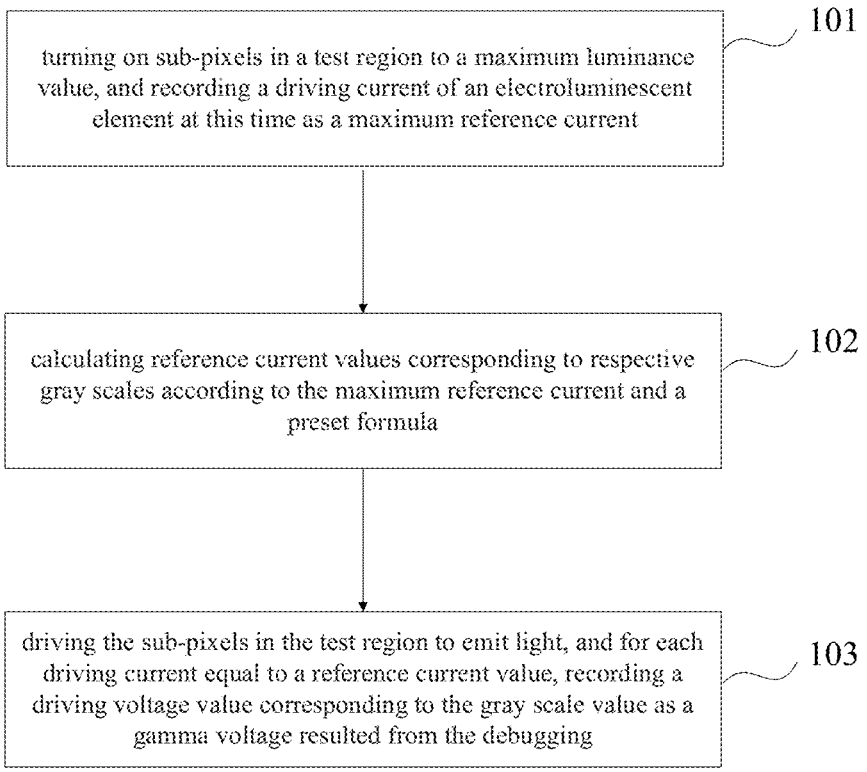
FIG. 1 is a flow chart of a gamma voltage debugging method provided in a first embodiment.

FIG. 1 is a flow chart of a gamma voltage debugging method provided in the first embodiment. As shown in FIG. 1, the gamma voltage debugging method provided in the first embodiment includes the following steps.

At step 101, sub-pixels in a test region are turned on to a maximum luminance value, and a driving current of the electroluminescent element at this time is recorded as a maximum reference current.

At step 102, reference current values corresponding to respective gray scales are calculated according to the maximum reference current and a preset formula.

In color display, each pixel is composed of at least three color sub-pixels: red, green and blue. Each color sub-pixel may present a different luminance level, that is, corresponding to a different gray scale. In the present embodiment, the maximum luminance may be a maximum display luminance of a sub-pixel of a certain color previously set according to the requirement of the product. In addition, since the electroluminescent element is driven by a current, the luminance thereof has the following relationship with the amount of the current flowing through the electroluminescent element:

$$L=I*\eta \qquad 1\text{-}1$$

Where L is a luminance of a sub-pixel, I is a current flowing through the electroluminescent element, and η is a luminous efficiency of the screen, which may be learned by conventional technical means in the art and will not be repeated herein. Thus, the pixel of the test region is illuminated to a given maximum luminance $L_{max}$. At this time, the current flowing through the electroluminescent element corresponds to the maximum reference current $I_{max}$. In the case when the maximum luminance is given, the luminance values corresponding to the respective gray scale values may be derived by fitting the standard gamma curve. It may be inferred that, in the case when the maximum reference current $I_{max}$ is known, the reference current values corresponding to respective gay scale values should satisfy the following formula:

$$I_{gray} = I_{max}\left(\frac{GL}{N_{gray_max}}\right)^{y} \qquad 1-2$$

Where $N_{gray_max}$ is the maximum gray scale value, GL is any gray scale between [0, $N_{gray_max}$], ands is a default gamma value. Presently in the related art, GAMMA 2.2 curve is commonly employed as a standard gamma curve. For example, for a color depth of 10 bits, the gray scale range is [0,1023], and reference currents corresponding to respective gray scales are:

$$I_{GL} = I_{max}\left(\frac{GL}{1023}\right)^{2.2} \qquad 1-3$$

The reference current values corresponding to respective gray scale values may be obtained by substituting the maximum current $I_{max}$ and the gray scale values into the formula 1-3, respectively, to obtain a lookup table as shown in Table 1:

TABLE 1

| Gray Scale Value | 0 | 1 | 2 | 3 | . . . | 1021 | 1022 | 1023 |
|---|---|---|---|---|---|---|---|---|
| Reference Current Value | $I_0$ | $I_1$ | $I_2$ | $I_3$ | . . . | $I_{1021}$ | $I_{1022}$ | $I_{1023}$ |

At step 103, the sub-pixels in the test region are driven to emit light, and for each driving current equal to a reference current value, a driving voltage value corresponding to the gray scale value is recorded as a gamma voltage resulted from the debugging.

In this step, in one embodiment, the pixel is driven to emit light with a set of driving voltages having a linear relationship with the preset gray scales. Assuming that the maximum voltage provided by the driving circuit is Vmax and the number of the preset gray scales is 11 bits, the accuracy for adjusting the driving voltage is VGL=Vmax/2048. It should be noted that the number of the preset gray scales needs to be greater than the number of displaying gray levels finally resulted from the debugging, and the more the preset gray scale values are, the more accurate the corresponding driving voltage adjustment will be, and the more accurate the debugging will be.

The screen is turned on and a picture is captured for each gray scale of the preset gray scales. At the same time, the measured current flowing through the electroluminescent element is monitored. When the measured current is equal to a reference current value in Table 1, the corresponding driving voltage value is recorded, to obtain driving voltage values corresponding to respective gray scale values, as shown in Table 2:

TABLE 2

| Gray Scale Value | 0 | 1 | 2 | 3 | . . . | 1021 | 1022 | 1023 |
|---|---|---|---|---|---|---|---|---|
| Reference Current Value | $I_0$ | $I_1$ | $I_2$ | $I_3$ | . . . | $I_{1021}$ | $I_{1022}$ | $I_{1023}$ |
| Driving Voltage | $V_0$ | $V_1$ | $V_2$ | $V_3$ | . . . | $V_{1021}$ | $V_{1022}$ | $V_{1023}$ |

Further, according to the formula 1-1, the luminance values corresponding to respective gray scale values may be obtained from the reference current values and the luminous efficiency of the electroluminescent element, resulting in a look-up table as shown in Table 3:

TABLE 3

| Gray Scale Value | 0 | 1 | 2 | 3 | . . . | 1021 | 1022 | 1023 |
|---|---|---|---|---|---|---|---|---|
| Reference Current Value | $I_0$ | $I_1$ | $I_2$ | $I_3$ | . . . | $I_{1021}$ | $I_{1022}$ | $I_{1023}$ |
| Luminance Value | $L_0$ | $L_1$ | $L_2$ | $L_3$ | . . . | $L_{1021}$ | $L_{1022}$ | $L_{1023}$ |
| Driving Voltage | $V_0$ | $V_1$ | $V_2$ | $V_3$ | . . . | $V_{1021}$ | $V_{1022}$ | $V_{1023}$ |

The data in the resulting table may be converted to Verilog-compatible format by software such as MATLAB. A program may be generated and burnt into a timing controller, or the data may be directly stored in a storage unit (e.g. Flash, EMMC, E2PROM, etc.) for direct access when performing display.

As may be seen from the above description, the gamma voltage debugging method described in the present embodiment focuses on a fixed function relationship between the driving currents and luminance values of the electroluminescent display element, and the gamma voltage debugging is performed directly by detecting driving currents. Since the adjusting and recording of the driving currents may be performed simultaneously and continuously and the driving voltages corresponding the currents may be provided by the driving circuit and may be recorded and outputted automatically. Therefore, it may achieve fast, precise adjustment, and the equipment may be relatively simple, suitable for mass production.

The Second Embodiment

Figure 2:
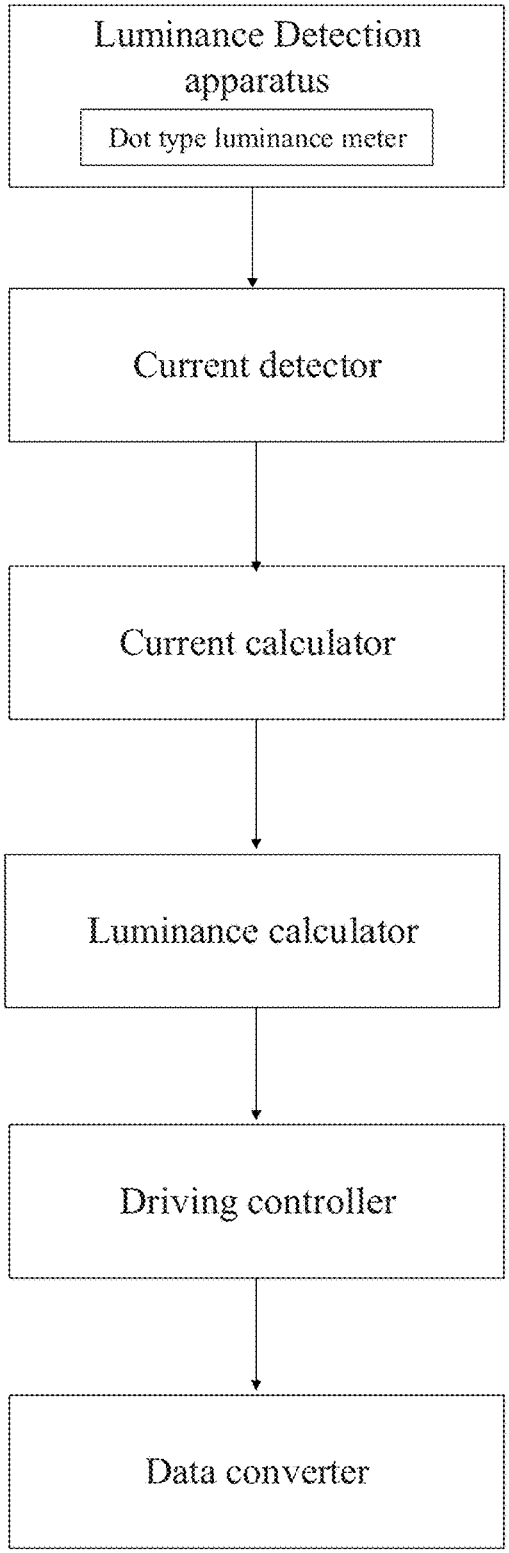
FIG. 2 is a schematic structural diagram of a gamma voltage debugging apparatus provided in a second embodiment.

FIG. 2 is a schematic structural diagram of a gamma voltage debugging apparatus applied to a display panel including an electroluminescent element provided in the second embodiment. The gamma voltage debugging apparatus includes:

a luminance detection unit configured to detect a luminance of a light emitted by a sub-pixel in a test region;

a current detection unit configured to record a driving current of the electroluminescent element as a maximum reference current when the luminance of the light emitted by the sub-pixel detected by the luminance detection unit reaches a maximum luminance value;

a current calculation unit configured to calculate reference current values corresponding to respective gray scale values according to the maximum reference current and the preset formula, the preset formula being:

$$I_{GL} = I_{max}\left(\frac{GL}{N_{gray_max}}\right)^{y}$$

where $N_{gray_max}$ is the maximum gray scale value, GL is any gray scale value between [0, $N_{gray_max}$], $\gamma$ is a default gamma value, $I_{max}$ is the maximum reference current, and $I_{GL}$ is the reference current value corresponding to GL; and a driving control unit configured to drive the sub-pixels in the test region to emit light, and when a driving current is equal to a respective reference current value, record the corresponding driving voltage value as a gamma voltage resulted from the debugging.

The luminance detection unit may be implemented as a dot type luminance meter or other luminance measurement apparatus. The current detection unit may be built on a timing controller and configured to monitor a total current flowing through the electroluminescent element in a sub-pixel in operation in the driving circuit. The driving control unit may specifically include a signal generator, a driving circuit, a register, etc., and may be preferably implemented by an integrated IC (the IC may be placed outside the substrate of the display device or in a non-display region of the substrate).

In one embodiment, the gamma voltage debugging apparatus further includes a data conversion unit configured to convert the gamma voltage data resulted from the debugging into a hardware description language and generate a program burnt to a timing controller of the electroluminescent display panel.

Further, the apparatus may further include a luminance calculation unit configured to calculate the luminance values corresponding to respective gray scales according to reference current values corresponding to the respective gray scales acquired from the current calculation unit and the luminous efficiency of the electroluminescent element.

The gamma voltage debugging apparatus provided in the present embodiment may be used to perform the gamma voltage debugging method described in the previous embodiment, and the principle and effect thereof are similar to those described below. The gamma voltage debugging apparatus described in the present embodiment may effectively improve the accuracy and speed of gamma voltage debugging and is suitable for gamma voltage adjustment of products in mass production.

The foregoing embodiments are merely illustrative of the technical aspects of the present disclosure and are not intended to be limiting thereof. Although the present disclosure has been described in detail with reference to the foregoing embodiments, it will be understood by those skilled in the art that it is still possible to modify the technical solutions described in the foregoing embodiments or to equivalently substitute some of the technical features therein, and these modifications or substitutions do not depart from the spirit and range of the technical solutions of the embodiments of the present disclosure.

What is claimed is:

1. A gamma voltage debugging method for an electroluminescent display panel, comprising:

turning on sub-pixels in a test region to a maximum luminance value, and recording a driving current of an electroluminescent element at this time as a maximum reference current;

calculating reference current values corresponding to respective gray scales for each of sub-pixels according to the maximum reference current and a preset formula:

$$I_{GL} = I_{max}\left(\frac{GL}{N_{gray_max}}\right)^{y}$$

where $N_{gray_max}$ is a maximum gray scale value, GL is any gray scale between [0, $N_{gray_max}$], and $\gamma$ is a default gamma value, $I_{max}$ is the maximum reference current value, and $I_{GL}$ is a reference current value corresponding to GL;

driving the sub-pixels in the test region to emit light, and for each driving current of sub-pixels equal to a reference current value, recording a driving voltage value corresponding to the gray scale value as a gamma voltage resulted from the debugging; and converting gamma voltage data resulted from the debugging into a hardware description language and generating a program burnt to a timing controller of the electroluminescent display panel.

2. The gamma voltage debugging method according to claim 1, herein the step of driving the sub-pixels in the test region to emit light comprises: driving the pixel to emit light with a set of driving voltages having a linear relationship with the preset gray scales.

3. The gamma voltage debugging method according to claim 2, further comprising:

converting gamma voltage data resulted from the debugging into a hardware description language and generating a program burnt to a timing controller of the electroluminescent display panel.

4. The gamma voltage debugging method according to claim 1, wherein for each driving current equal to a reference current value, recording a driving voltage value corresponding to the gray scale value as a gamma voltage resulted from the debugging comprises:

capturing a picture for each gray scale of the preset gray scales, at the same time, monitoring a measured current flowing through the electroluminescent element, and when the measured current is equal to a reference current value, recording the corresponding driving voltage value to obtain a driving voltage values corresponding to the respective gray scale value.

5. The gamma voltage debugging method according to claim 4, further comprising:

converting gamma voltage data resulted from the debugging into a hardware description language and generating a program burnt to a timing controller of the electroluminescent display panel.

6. The gamma voltage debugging method according to claim 1, further comprising:

obtaining luminance values corresponding to respective gray scale values from the reference current values and luminous efficiency of the electroluminescent element.

7. The gamma voltage debugging method according to claim 6, further comprising:

converting gamma voltage data resulted from the debugging into a hardware description language and generating a program burnt to a timing controller of the electroluminescent display panel.

8. The gamma voltage debugging method according to claim 6, wherein a luminance value corresponding to a gray scale value is a product of a reference current value corresponding to the gray scale value and the luminous efficiency of the electroluminescent element.

9. The gamma voltage debugging method according to claim 8, further comprising:

converting gamma voltage data resulted from the debugging into a hardware description language and generating a program burnt to a timing controller of the electroluminescent display panel.

10. The gamma voltage debugging method according to claim 1, wherein the maximum luminance value is a preset maximum displaying luminance of a sub-pixel of a certain color.

11. The gamma voltage debugging method according to claim 10, further comprising:

converting gamma voltage data resulted from the debugging into a hardware description language and generating a program burnt to a timing controller of the electroluminescent display panel.

12. A gamma voltage debugging apparatus, applied to a display panel comprising an electroluminescent element, and the gamma voltage debugging apparatus comprising:

a luminance detection apparatus configured to detect a luminance of a light emitted by a sub-pixel in a test region;

a current detector configured to record a driving current of the electroluminescent element as a maximum reference current when the luminance of the light emitted by the sub-pixel detected by the luminance detection apparatus reaches a maximum luminance value;

a current calculator configured to calculate reference current values corresponding to respective gray scale values for each of sub-pixels according to the maximum reference current and a preset formula, the preset formula being:

$$I_{GL} = I_{max}\left(\frac{GL}{N_{gray_max}}\right)^{y}$$

where $N_{gray_max}$ is a maximum gray scale value, GL is any gray scale between [0, $N_{gray_max}$], and γ is a default gamma value, $I_{max}$ is the maximum reference current value, and $I_{GL}$ is a reference current value corresponding to GL;

a driving controller configured to drive the sub-pixels in the test region to emit light, and when a driving current is equal to a respective reference current value, record the corresponding driving voltage value as a gamma voltage resulted from the debugging; and a data converter configured to convert the gamma voltage data resulted from the debugging into a hardware description language and generate a program burnt to a timing controller of the electroluminescent display panel.

13. The gamma voltage debugging apparatus according to claim 12, further comprising:

a luminance calculator configured to calculate the luminance values corresponding to respective gray scales according to reference current values corresponding to the respective gray scales acquired from the current calculation unit and the luminous efficiency of the electroluminescent element.

14. The gamma voltage debugging apparatus according to claim 12, wherein luminance detection apparatus comprises a dot type luminance meter.

* * * * *